US009986757B2

(12) United States Patent
Griesmayr et al.

(10) Patent No.: US 9,986,757 B2
(45) Date of Patent: Jun. 5, 2018

(54) COATING METHOD

(71) Applicant: TANNPAPIER GMBH, Traun (AU)

(72) Inventors: Guenter Griesmayr, Wels (AT); Barbara Puehringer, Oftering (AT); Bernhard Knauseder, Leonding (AT); Eike Schopper, Hoersching (AT)

(73) Assignee: TANNPAPIER GMBH, Traun (AT)

( * ) Notice: Subject to any disclaimer, the term of this patent is extended or adjusted under 35 U.S.C. 154(b) by 12 days.

(21) Appl. No.: 15/024,776

(22) PCT Filed: Sep. 25, 2014

(86) PCT No.: PCT/AT2014/050219
§ 371 (c)(1),
(2) Date: Mar. 24, 2016

(87) PCT Pub. No.: WO2015/042627
PCT Pub. Date: Apr. 2, 2015

(65) Prior Publication Data

US 2016/0262446 A1 Sep. 15, 2016

(30) Foreign Application Priority Data

Sep. 27, 2013 (AT) ..... A 50626/2013

(51) Int. Cl.
*B32B 3/00* (2006.01)
*A24C 5/56* (2006.01)
(Continued)

(52) U.S. Cl.
CPC ..... *A24C 5/565* (2013.01); *A24C 5/005* (2013.01); *A24D 1/02* (2013.01); *A24F 15/00* (2013.01); *D21H 19/824* (2013.01); *D21H 21/16* (2013.01)

(58) Field of Classification Search
CPC ..... A24D 1/02; A24C 5/005; A24C 5/565; D21H 21/16; D21H 19/824
See application file for complete search history.

(56) References Cited

U.S. PATENT DOCUMENTS 1,998,099 A 4/1935 Shankweller
2,159,704 A 5/1939 Levey
(Continued)

FOREIGN PATENT DOCUMENTS

AT 513413 4/2014
DE 2743986 4/1979
(Continued)

OTHER PUBLICATIONS

International Search Report for PCT/AT2014/050219, English translation attached to original, Both completed by the European Patent Office dated Apr. 2, 2015, 7 Pages.

*Primary Examiner* — Elizabeth E Mulvaney
(74) *Attorney, Agent, or Firm* — Brooks Kushman P.C.

(57) ABSTRACT

A coating method for sheathing material formed from paper or card for smoking materials or parts of smoking materials in order to reduce the tendency of the sheathing material to absorb and diffuse aqueous or oily substances, the sheathing material being provided on the same side with two coatings, which are applied one on top of the other and are each applied in liquid form in two successive coating steps. In the first coating step, at least one layer of a first coating substance is applied, which reduces the ability of the paper or card to absorb the liquid volatile matrix of the second coating substance; in the second coating step, at least one layer of a second coating substance is applied, which is repellent or impermeable to one or more of the following substances: oils, fats, waxes, alcohols, and water.

24 Claims, 2 Drawing Sheets

(51) Int. Cl.

| | |
|---|---|
| ***A24C 5/00*** | (2006.01) |
| ***A24D 1/02*** | (2006.01) |
| ***A24F 15/00*** | (2006.01) |
| ***D21H 19/82*** | (2006.01) |
| ***D21H 21/16*** | (2006.01) |

(56) References Cited

U.S. PATENT DOCUMENTS

| | | | |
|---|---|---|---|
| 4,185,643 | A | 1/1980 | Riedesser |
| 9,115,471 | B2 | 8/2015 | Zitturi et al. |
| 2004/0099280 | A1 | 5/2004 | Stokes et al. |
| 2004/0159414 | A1 | 8/2004 | Durhammer |
| 2008/0003384 | A1 | 1/2008 | Murphy et al. |
| 2009/0065012 | A1 | 3/2009 | Patel et al. |
| 2015/0237912 | A1 | 8/2015 | Griesmayr et al. |

FOREIGN PATENT DOCUMENTS

| | | |
|---|---|---|
| EP | 1044615 | 10/2000 |
| EP | 1418272 | 5/2004 |
| EP | 2551407 | 1/2013 |
| GB | 191401783 | 7/1915 |
| WO | 2009027331 | 3/2009 |

COATING METHOD

CROSS-REFERENCE TO RELATED APPLICATION

This application is the U.S. national phase of PCT Application No. PCT/AT2014/050219 filed on Sep. 25, 2014, which claims priority to AT Patent Application No. A 50626/2013 filed on Sep. 27, 2013, the disclosures of which are incorporated in their entirety by reference herein.

The invention relates to a coating method for wrapping material formed from paper or board for smoking products or parts of smoking products, the coating method having the purpose of reducing the tendency of this wrapping material to pick up aqueous or oily substances, and reducing the diffusion or migration of such substances through the paper or the board. Furthermore, the invention relates to the correspondingly coated wrapping material.

The invention will be described below predominantly by using mouthpiece lining paper for cigarettes as an exemplary wrapping material according to the invention. The reason for this is that the mouthpiece lining paper is the supposedly most important application for the invention and that the description will become more easily understandable as a result of the concentration on only a single application. Only in the last part of the description will further applications also be discussed briefly.

Important parts of a conventional filter cigarette are the tobacco rod, the filter and wrapping material in the form of the cigarette paper encasing the tobacco rod, the filter casing paper directly encasing the filter and the mouthpiece lining paper.

The mouthpiece lining paper, often also designated "tipping paper" or "tipping" for short, is that part of the filter cigarette which, during the smoking of the filter cigarette, is touched by the lips of the person smoking the cigarette. It encases the filter part and usually also projects in the longitudinal direction of the filter cigarette and slightly into the longitudinal region of the tobacco rod and encases the cigarette paper there. It is connected to the filter casing paper and the cigarette paper by an adhesive bond. As a result of the production of this adhesive bond, filter part and tobacco rod part are connected mechanically in the cigarette machine.

The mouthpiece lining paper is mostly actually a paper but can also be a film or a foil or else a composite material made of a plurality of layers of different materials.

The mouthpiece lining paper normally has a print. For example, this print can be reminiscent of cork.

In the Austrian patent application A 1013/2012 from the applicant, not yet published at the priority date of the present application (published as AT 513413 A1 in the meantime), mention is made of the requirement that there should be an oil-tight barrier between the outer layer of the mouthpiece lining paper and the filter casing paper, in particular when the mouthpiece lining paper is provided with a substance having sensory action (e.g. a substance which brings about a sensation of cold when touched with the lips), since thereby the generally undesired diffusion of this substance into the filter material is prevented. According to A 1013/2012, it is proposed to fit an oil-tight film between mouthpiece lining paper and filter casing paper for this purpose.

EP 2551407 B1 proposes a filter casing paper which, as compared with other filter casing papers, retards oil diffusion considerably better but itself is still a lightweight and very porous, therefore highly air-permeable, paper, as is important for filter casing papers. The filter casing paper is advantageous in particular when use is made of filters which contain liquid flavoring which, although it is intended to enrich the stream of smoke, is not intended to diffuse so intensely through the filter casing paper and into the mouthpiece lining paper running around the outside on the finished cigarette that visible stains are produced on the visible surface of the mouthpiece lining paper. According to EP 2551407 B1, for this purpose a specific base paper—defined by the level of refining of the long fiber pulp and the proportion of fillers—which is impregnated with an aqueous composition, in particular an aqueous solution or suspension, is proposed for the filter casing paper. In a development in this regard, following the impregnation, a layer is additionally applied to the filter casing paper in a likewise aqueous solution.

DE 2743986 A1 proposes a mouthpiece lining paper which is through-dyed and is provided with an embossing which is reminiscent of the natural surface of cork. As a protective coating for the embossing and in order to achieve a glossy effect, the side of the mouthpiece lining paper that is intended as the visible side is additionally provided with a varnish layer. Varnishes, by way of example shellac, ethyl cellulose and polyethylene wax styrene acrylate, are named as varnishes for this purpose.

WO 2009027331 A2 proposes a mouthpiece lining paper which is coated with a composite made of nitrocellulose varnish and a cold-sensation material.

EP 10446115 B1 proposes a cigarette paper (that is to say a paper provided for encasing the tobacco rod) which is provided with a water-repellent impregnation made of a cellulose derivative. In order to achieve a desired good air permeability of the cigarette paper despite the impregnation, it is proposed to apply the impregnation in a plurality of coating operations following one another chronologically.

US 2009/0065012 A1 and US 2004/0099280 describe multiple coatings for cigarette paper (i.e. a paper provided for encasing the tobacco rod) which are applied in a plurality of strips in order to form self-extinguishing cigarettes.

The object on which the invention is based consists in providing wrapping material, in particular mouthpiece lining paper in that processing state starting from which, as far as the processing in the cigarette machine, only one or more customer-specific prints that can be perceived visually and/or by the senses is/are missing. The specific requirements on the mouthpiece lining paper to be provided in the aforesaid processing state are:

- The mouthpiece lining paper is actually to be a paper and not a film. (This is primarily required for haptic reasons, for reasons of further printability and for reasons of the ability to be processed in the cigarette machine.)
- The mouthpiece lining paper coated in accordance with the invention is to have, irrespective of further customer-specific prints and as compared with other papers used as mouthpiece lining paper, a considerably lower tendency to the formation of stains as a result of picking up aqueous, oily, greasy, waxy or alcoholic substances and diffusion of these substances through the mouthpiece lining paper.
- The desired "stain avoidance" of the mouthpiece lining paper is to be reliable and achievable irrespective of the properties of the base paper used.

In order to achieve the object, it is proposed that the base paper coming from the papermaking process be provided with coatings applied in liquid form in two coating operations taking place after each other chronologically, wherein, in the first coating operation, a weakly hydrophobic coating material is applied with a preferably organic solvent as a liquid volatile matrix and wherein, in the second process, a highly hydrophobic and oil-repellent coating material is applied with preferably water as a liquid volatile matrix. "Liquid volatile matrix" is understood to mean all types of solvents (inorganic and organic) and dispersion media from dispersions, emulsions or suspensions.

The first coating operation has substantially the purpose of protecting the paper against damage as a result of the water necessarily applied at the same time during the second coating operation. Only with the second coating operation is that coating applied which effects the decisive desired effect of "stain avoidance", such as in particular the lowest possible tendency to the picking up and migration or diffusion of aqueous, oily, waxy and alcohol-based substances. According to the present text, a coating operation is defined as the application of a coating material; a coating operation can also consist in the separate chronological application of a plurality of layers of the coating material overlaying one another.

The desired effect of "stain avoidance" requires a coating which is oil-repellent or even oil-tight. The oil-repellent or oil-tight coating materials which are known to the applicant at the time of the invention and which can be applied in liquid form are dissolved in water or aqueous solutions or are present as a dispersion with water as dispersion medium. However, water can be used only to a very limited extent as a volatile liquid matrix for paper coatings, since untreated paper absorbs water quickly and in the process can change as far as permanent unusability, specifically becomes soft and rough, enlarges its encasing surface, forms waves, and can no longer be processed further.

Because, before the application of the second, ultimately essential oil-repellent coating, which is based on water as a volatile liquid matrix, a coating which is not based on water as a volatile liquid matrix and which reduces the water absorption capacity of the paper is applied first, it is possible to apply a considerably greater quantity of the second coating than would otherwise be possible, and therefore also to achieve a considerably better desired effect ("stain avoidance") than would otherwise be possible. Stains designates local changes in the appearance as a result of water, alcohols, solvents, waxes, greases or oils (for example fatty oils, mineral oils, silicone oils, essential oils). Of course, the invention can also be applied in the case of such a second coating which, although the volatile liquid matrix thereof is not based on water, would also change the properties of the paper or of the board in the undesired way. The first coating is therefore used in a manner generally formulated for the purpose of reducing the absorption capacity of the paper or of the board with respect to the volatile liquid matrix of the second coating.

The coating according to the invention is particularly advantageous in the case of paper grades having a low grammage (under 80 g/m$^2$, preferably under 40 g/m$^2$), since the detrimental influence of the paper properties increases with an increase in the absolute moisture content in the paper.

The invention will now be explained in more detail with reference to an exemplary embodiment.

Figure 1:
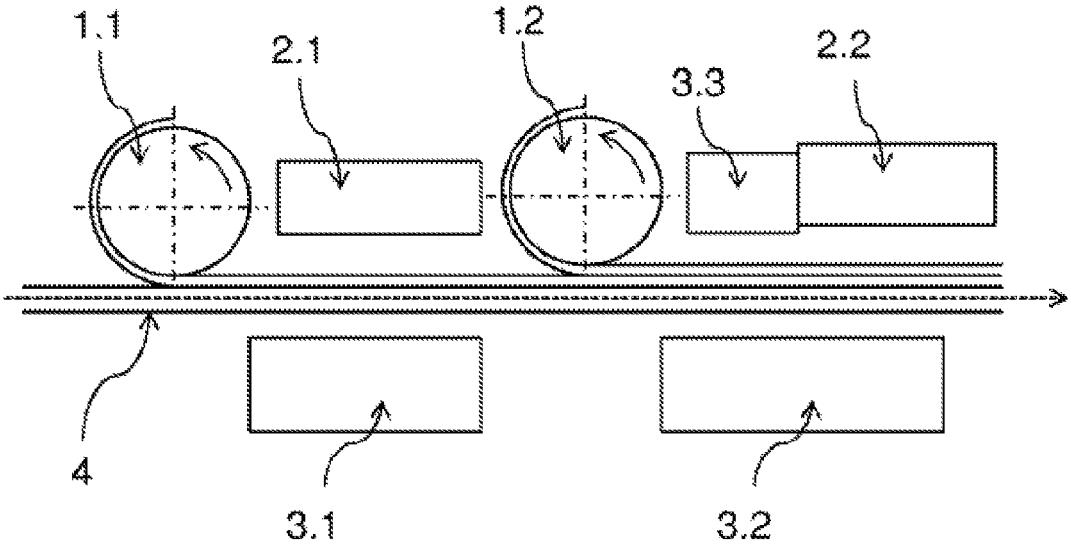
FIG. 1 shows the schematic illustration of an exemplary coating method according to the invention.

In FIG. 1, an exemplary online method for producing a paper coated in accordance with the invention is shown. In this connection, "online" states that the paper is present as a paper web 4, which is drawn through the coating system and is coated continuously. The paper web is normally unwound from a paper roll (parent roll or spool) and, after coating has been carried out, is wound up again to form a paper roll or processed further directly, for example cut into strips. According to the example, the coating according to the invention is carried out in four partial steps:

In the first step, the first, lower coating is applied by a coating device 1.1.

In the second step, the first coating is dried.

In the third step, the second coating is applied over the first coating in the coating device 1.2.

In the fourth step, the second coating is dried.

Here, the first and second step and/or the third and fourth step can be carried out repeatedly. This means that the first and/or second coating operation can be carried out by the application of a plurality of layers applied chronologically one after another.

As modifications, it would be conceivable to apply the lower or both coatings according to the invention on both sides or to apply one of the two coatings in a plurality of layers one after another chronologically, each application of a layer being followed by a drying process. There is also the possibility of providing a printing device after the coating devices, in order to apply a print having an optical, haptic, sensory or other function to the dried coating or to the other paper side. Also conceivable would be to carry out the application of the first coating and the second coating on two separate systems, for example for space or process engineering reasons. In this case, the paper web 4 is even wound up to form a paper roll following the drying of the first coating. This paper roll is then transported to a second system, where the paper web (4) is unwound and provided with the second coating.

As shown in FIG. 1, the drying can be accelerated by the action of hot air or infrared radiation. A combination of hot air and infrared drying has proven to be a particularly worthwhile drying method for the coating according to the invention. Here, the coating is, for example, firstly irradiated with infrared radiation, preferably from the uncoated rear side of the paper. Thus, the coating begins to dry first at a depth, that is to say on the paper. As a result, the evaporated solvent (or, generally, the volatile liquid matrix) can escape through the upper, still liquid layers of the coating, which are present in the air. As soon as sufficient solvent has evaporated from the lower layers, the evaporation of the solvent close to the surface can be carried out by means of additional acceleration of the drying from the coated side of the paper with infrared or hot air. This drying method is particularly worthwhile for the second coating, since the volatile liquid matrix of this coating is not able to escape through the already dried first coating located underneath.

The number and arrangement of the hot air and infrared sources (2.1, 2.2, 3.1, 3.2, 3.3), and the intensity and duration of the action as a result of the latter depends on the paper used and on the type and quantity of the varnish used and can best be determined by experiment. For the arrangement with regard to the paper, the following may be cited by way of example: one or more infrared sources (3.1, 3.2, 3.3) on one side from above (coating side), on one side from below or on both sides; one or more hot air sources (2.1, 2.2) on one side from above, on one side from below or on both sides; and combinations of the aforementioned arrangements of infrared sources (3.1, 3.2, 3.3) and hot air sources (2.1, 2.2). The action by the infrared sources (3.1, 3.2, 3.3) and hot air sources (2.1, 2.2) can be carried out simultaneously or in a staggered manner.

EXAMPLE

The starting material is an exemplary base paper based on pulp fibers, such as is usual for mouthpiece lining paper. It has a grammage (area-based mass) of about 20-80 g/m$^2$, 35 g/m$^2$ in the present example.

Were the base paper to be provided directly with the second coating (e.g. styrene-acrylate varnish based on water) without the first coating operation, then the highly absorbent base paper would pick up approximately all of the quantity of the liquid component of the varnish. In the case of a solids application of 5 g/m$^2$ and a typical varnish composition having a proportion of solids relative to the proportion of liquid of 30:70, the mass of the liquid applied would be 11.7 g/m$^2$. Thus, 11.7 g of water are applied per 35 g of paper, which corresponds to an increase in the absolute paper moisture, defined as [(mass of moisture−dry mass)/mass of moisture], of about 25% by weight. By comparison, in the case of the same coating with a grammage of 80 g/m$^2$, the absolute paper moisture would increase by only 12.7% by weight. The applicant has established that, with an increase in the regular paper moisture (4-7% by weight) to an absolute paper moisture of about 14% by weight, the paper properties are influenced detrimentally in such a way that the mouthpiece lining paper can no longer be processed practically. This illustrates the high importance of the coating according to the invention, specifically for absorbent paper grades with a low grammage since, as a result of the first coating, the absorption capacity of the paper for the liquid component of the second coating is reduced.

For the first coating operation, shellac is used as coating material. Shellac is mixed with ethanol as solvent until, when the viscosity of the mixture is measured by using the flow cup test with a cup diameter of 4 mm (ISO 4 mm cup according to EN ISO 2431 version 1993-02-15), a flow time between 18 and 22 seconds results. For each m$^2$ of paper, 1 to 6 g, preferably 3 to 3.5 g, dry application quantity of this mixture is applied uniformly to the base paper using the gravure printing process.

The dry application quantity can be measured as the increase in weight of the paper following drying of the coating and thus represents the mass of the applied non-volatile coating material.

After the first coating operation, the paper is dried in air at a temperature of 70° C. to 120° C. for at least 1-4 seconds.

It is possible to test the success of the first coating, namely "falling below a maximum permissible water absorption capacity of the paper from the side of the coated surface" by means of what is known as the standardized Cobb test (ISO 535). If water is used as test liquid and Cobb 300 (subjected to the quantity of sample water for 300 seconds) or a longer Cobb test can be carried out successfully, then the aforesaid water absorption capacity is sufficiently low for this processing stage. (In accordance with the standard, the test can be carried out when no water penetrates through more than 80% of the samples within the test period). In the case of the samples, Cobb 300 values of less than 25 g/m$^2$ were measured.

The second coating is applied to the same side of the paper as the first coating, therefore covers the first coating. For the second coating operation, styrene-acrylate varnish, in which water is the liquid volatile matrix, is used. The proportion of water is so high that, when the viscosity is measured with the flow cup test with a cup diameter of 4 mm (ISO 4 mm cup according to EN ISO 2431 version 1993-02-15), a flow time between 11 and 23 seconds results. For each m$^2$ of paper, 1 to 6 g of dry application of the coating material, which is present in the liquid volatile matrix of the liquid varnish, is applied uniformly using the gravure printing process.

After the second coating operation, the paper is dried in air at a temperature of 70° C. to 120° C. for at least 1-4 seconds.

After the second coating, too, the success can be tested with the aid of the Cobb test (ISO 535). Once more, Cobb 300 can be used; in this case the test must be possible both with water and also with oil as test liquid. The test with oil is carried out following the model of the SCAN-P 37:77 Standard, which describes the Cobb-Unger method. The CobbU value indicates the mass (in grams) of oil which is absorbed in a square meter of paper over a standard time period (6, 10 or 30 seconds). The modification to the test consists in that the CobbU 300 (test period 300 seconds) is determined. Cobb 300 was chosen since the time period corresponds approximately to the time period of the smoking of a cigarette. Here, in the case of a successful coating with both test liquids, the result is a Cobb 300 value and CobbU 300 value of less than 1 g/m$^2$, preferably less than 0.5 g/m$^2$ increase in weight of the paper as a result of test liquid absorbed by the coated surface during the test period. The standardized CobbU 30 value (test period 30 seconds with oil) therefore also lies below 1 g/m$^2$ and, respectively, below 0.5 g/m$^2$.

What is known as the KIT test, which is usual for the assessment of the resistance to oil and grease diffusion in paper, is also very highly suitable as a test method for the success of the second coating—and therefore also inclusive of the success of the first coating. On the 12-part results scale, given proper application of both coatings, at least the value 11 is reached; however, it is also entirely possible, and of course preferred, for a value of 12 to be achieved. The value 12 signifies the highest resistance against diffusion by oily or similar substances.

(The official title of the KIT test is "Grease resistance test for paper and paperboard T 559 cm-12"; the responsible standardization organization is TAPPI (Technical Association of the Pulp and Paper Industry). According to the test, drops of 12 exactly defined oily liquids are dropped onto the coated paper side and, for each drop, it is observed whether the respective liquid penetrates as far as the second surface within a standardized test period. The oily liquids are numbered and have a higher diffusion capability with increasing number. The result of the test is the highest of those numbers at which the associated liquid does not penetrate as far as the second paper surface within the test period.)

Modifications and generalizations relating to the coating of the paper in accordance with the invention according to the example are:

For the first coating operation, in addition to the shellac mentioned, ethyl cellulose varnish (preferably applied in multiple layers), alkyd resin varnish or nitrocellulose varnish are also suitable as coating materials, where combinations of varnishes mentioned can be particularly advantageously used, for example a mixture of shellac and nitrocellulose varnish or ethyl cellulose varnish or a mixture of alkyd resin varnish and nitrocellulose varnish or ethyl cellulose varnish. The varnishes or varnish combinations mentioned can also advantageously be used in combination with paraffin wax, for example nitrocellulose varnish, alkyd resin varnish or ethyl cellulose varnish in combination with paraffin wax. Generally, varnishes and coating materials with similar physical properties to the aforementioned varnishes, primarily with regard to density and hydrophobia, can be used. Instead of ethanol, ethyl acetate, for example, can also be used well as organic solvent.

The viscosity of the still liquid coating mixture for the first coating operation should be such that, in the flow cup test, a flow time between 13 and 35 seconds results (preferably 18-22 seconds). With increasing viscosity, the concentration of the coating material is higher and therefore more thereof is applied per printing process but it also becomes more difficult to obtain the layer faultlessly densely.

In the first coating operation, a dry application of the coating material of 1 to 6 $g/m^2$ should be applied with the coating mixture, preferably at least 3 $g/m^2$.

For the second coating operation, in addition to the aforementioned styrene-acrylate varnishes, quite generally varnishes and coating materials having similar physical properties, above all with regard to density, hydrophobia and wettability by oily substances, are of course also suitable.

The viscosity of the still liquid coating mixture for the second coating operation should be such that, in the flow cup test, a flow time between 11 and 23 seconds, preferably 11 and 12 seconds, results.

Because a relatively highly viscous coating mixture is used in the first coating operation, the risk that the paper will be damaged by excessively high proportions of liquid is reduced. Because a less viscous coating mixture is used during the second coating operation, a smoother, better closed surface is achieved.

Gravure printing as an application method is advantageous, since it is usual for the printing of mouthpiece lining paper and is highly suitable for many kinds of technical reasons. Within the context of the idea of the invention, however, it is in principle immaterial which method is used to apply the liquid coating mixtures, as long as the given rules for quantity per area, uniformity and consistency of the coating mixtures are complied with. It is therefore also possible for the flexographic printing process or other application methods to be used.

The coating materials of both coatings are preferably transparent and colorless but can also contain a proportion of color. Furthermore, it is possible for the coating mixtures to have additives and further components such as waxes and resins, for example paraffin wax, added thereto.

As already mentioned for the first coating in the case of ethyl cellulose varnish by way of example, the first coating can also be carried out in multiple layers when other varnishes are used; the same is true of the second coating.

The coating according to the invention is also advantageous when—otherwise than mentioned in the example—use is made of papers which are intrinsically designated "wet strength", since they are better resistant to wet then conventional papers, as a result of the type of additives (wet-strength agent or wet-strength size) contained in the paper. In this case, the absorption and diffusion capability of aqueous or oily substances is reduced still further from a lower initial value. Depending on the properties of the starting material used and the objective of "stain avoidance capability", it is possible to manage with a less thick layer application according to the invention (a greater or lower quantity of liquid coating mixture or less or more volatile liquid matrix).

For quick testing to see whether the suitable parameters in the coatings have been chosen for a paper grade, and whether the method has been carried out faultlessly, the so-called ink float method is very highly suitable. Here, the coated paper is laid with the coated side down on the liquid level of an ink bath (with standardized ink) and it is observed whether and in what time ink penetrates as far as the upper side of the paper and colors the latter. In the case of sufficiently good coatings of mouthpiece lining paper, a time of at least 15 seconds has been measured in the ink float method after the first coating operation until ink has penetrated as far as the upper side of the paper. After the second coating operation, this measured time is more than 300 seconds.

Figure 2:
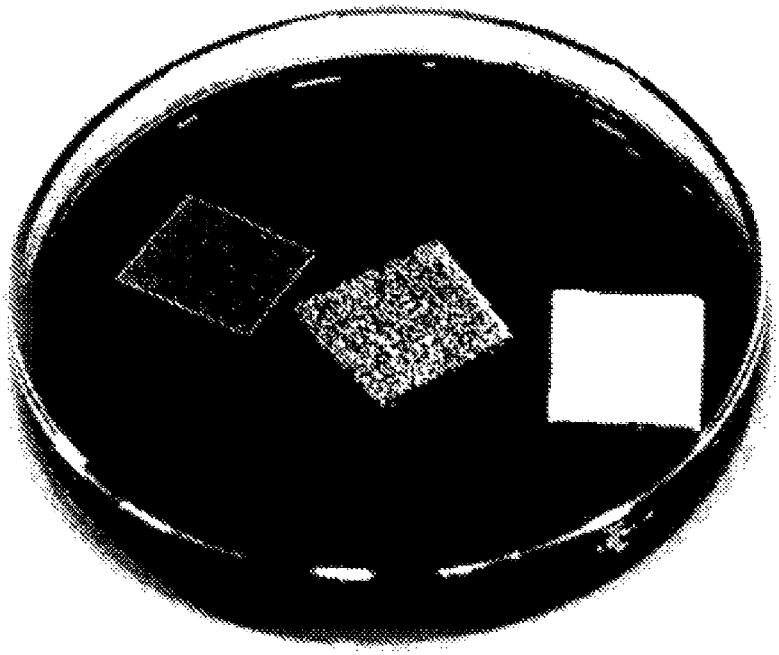
FIG. 2 shows, as a result of an ink float test, a mouthpiece lining paper coated in accordance with the invention and two comparative papers.

In FIG. 2, the result of the ink float test after 300 seconds is depicted. For the experiment, a typical mouthpiece lining paper was used. In the ink bath there are three pieces of paper, on the left the mouthpiece lining paper without any coating, in the center with a first coating formed by shellac, and on the right the mouthpiece lining paper according to the invention with a first coating by means of shellac and a second coating applied thereto using styrene-acrylate varnish. The uncoated paper can be seen as a black area delimited by a white border, since it is already completely impregnated with the ink. The speckled surface of the singly coated paper shows that the ink has already penetrated the paper at the black points. The mouthpiece lining paper according to the invention, provided with two different coatings, still shows no indications of discoloration and can be seen as a white rectangle.

This test confirms that the water absorption capacity is reduced sharply by the coating according to the invention, specifically so sharply that discoloration of the paper is ruled out for at least 5 min. Thus, given proper use of the mouthpiece lining paper, it is ensured in every case that aqueous substances cannot penetrate said paper. Liquid substances which are contained in the interior of the cigarette or are liberated during the smoking cannot penetrate said paper and do not appear as visible stains on the outer side of the mouthpiece lining paper.

Of course, liquid substances which act on the mouthpiece lining paper from outside are prevented from penetrating the latter and getting into deeper layers of the cigarette.

On the basis of this aspect, a further very advantageous application of the coating according to the invention has been discovered. Since, at the end of the cigarette facing away from the tobacco rod, said cigarette usually comes into contact with the lips of the smoker, in this area it is subjected to moisture which, depending on the smoking habit, acts with different intensity on the cigarette. As a result, it is possible for the paper of the cigarette to soften and to stick to the lips of the smoker.

It has transpired that the coating according to the invention is also excellently well suited to solving this problem. For this purpose, the coating according to the invention is applied to the outside in the area of the smoking article which comes into contact with the lips of the smoker. In the case of modern filter cigarettes, this is approximately the third of the mouthpiece lining paper that is located facing away from the tobacco part. Expediently, the mouthpiece lining paper can also be coated even before the assembly of the cigarette.

When an appropriately pre-treated mouthpiece lining paper is used on a filter cigarette, it has been shown that said paper is not softened even after long contact with saliva. In addition, it was also possible to prevent the lips remaining stuck to the paper somewhat when releasing the cigarette, which is felt by many smokers to be unpleasant. Coatings which are intended to prevent such adhesion are also designated lip-release coatings. It has transpired that the lip-release effect of the coating according to the invention is even more highly pronounced and maintained for longer than in the case of coatings according to the prior art, such as a coating with nitrocellulose varnish.

Advantages and advantageous variants of mouthpiece lining papers produced in accordance with the invention should be explained in brief:

If paper has been coated with a coating according to the invention on only one side, the second side of the paper is still highly water-absorbent. This is very desirable during the processing of mouthpiece lining paper in the cigarette machine, since there the speed of processing depends substantially on how quickly an adhesive bond to itself of mouthpiece lining paper wound around the filter part at the overlapping point of the mouthpiece lining paper has reached a certain minimum strength. The increase in strength rises with the capability of the paper to extract moisture out of the glue used for the aforesaid adhesive bonding. If only one paper side has been coated in accordance with the invention, at least one of the two paper surfaces to be joined to each other is still absorbent to liquids or moisture during the adhesive bonding. Therefore, an acceptably quick increase in strength is achieved during the adhesive bonding. (Mouthpiece lining papers which are formed by an entirely non-absorbent film or which consist of entirely highly wet-strength sized paper are problematical in this regard.)

If, by means of the mouthpiece lining paper, a very good barrier action in both directions (out of the filter and into the filter) is to be achieved, it is expedient to coat on both sides in accordance with the invention. Because the coating is applied as a print, it is entirely possible and advantageous to leave individual subareas unprinted on one side of the paper, in particular precisely those subareas which, during the processing of the paper in the cigarette machine, are used as adhesive bonding areas of the mouthpiece lining paper. This is particularly worthwhile for the overlapping area—and therefore adhesive bonding area—of the mouthpiece lining paper to itself on the cigarette. However, it is also useful for the adhesive bonding subarea of the mouthpiece lining paper with the filter casing paper and the cigarette paper.

The advantages of a coating according to the invention applied to the outer side of the mouthpiece lining paper are:

a) The surface is very much better suited to the further printing with visual or haptic varnishes than an untreated paper surface, since, as compared with the latter, it is very much smoother, denser and fault-free. It is therefore possible to print finer and more changeable structures and it generally requires less printing material for that purpose.

b) The surface has a so-called lip-release effect, which means that, even after relatively long contact with moist lips—such as corresponds to the smoking habits in some countries—it does not tend to remain stuck to the lips. In addition, it has surprisingly been established that the lip-release effect was even improved by the method according to the invention as compared with known coating methods.

c) The coated surface prevents substances that act on the senses, such as typically flavorings, which are often applied in a locally limited manner to the outer side of the mouthpiece lining paper, from being propagated in the mouthpiece lining paper, mixing with other substances likewise applied to the mouthpiece lining paper or even to some extent getting into the filter and, furthermore, into the stream of smoke. It is therefore made possible to use a wider range of substances that act on the senses, to use a wider range of combinations of these substances on a cigarette and also to provide a greater quantity of these substances on the outside of the mouthpiece lining paper than would otherwise be possible.

If the coating according to the invention is applied to the inner side of the mouthpiece lining paper, a main benefit resides in the fact that it prevents substances from diffusing from the interior of the encased area to the outer side of the mouthpiece lining paper and there causing visible stains and/or an undesired sensation of smell or taste. This type of barrier is particularly important if, in the filter part or else in the tobacco rod of the cigarette, in addition to the flavorings present in any case as a result of the tobacco, separate flavorings which are oily substances or containing the same are accommodated. Particularly important in terms of numbers here are the so-called Kretek cigarettes originally originating from Indonesia, in which clove oil, as liquid or as crushed cloves, and normally diverse other additives such as glycerin, molasses, palm sugar, cane sugar or further flavorings are added to the tobacco.

A newer substantial trend is the use of so-called flavoring capsules, primarily for incorporation in the filters of cigarettes. A flavoring capsule is a capsule, the outer sheath of which can be destroyed, for example by the exertion of pressure. As a result, the flavorings contained in the capsule in liquid form and the carrier substances thereof are liberated. The coating according to the invention is also best suited here to prevent the penetration of these substances to the outer side of the cigarette.

It is also possible, for example, for microcapsules in the form of microscopically small flavor capsules to be printed directly onto the outer side of the mouthpiece lining paper. The coating according to the invention is suitable to prevent the penetration of the substances contained therein into the interior of the cigarette.

Vanilla or menthol, for example, are used as flavorings for flavor capsules, microcapsules or the direct printing. Polyethylene glycol (PEG), for example, is used as a carrier material for flavorings.

If the coating according to the invention is applied only to the inner side of the mouthpiece lining paper, it can be felt to be a haptic advantage if the mouthpiece lining paper on the cigarette feels softer and less like a film than it would feel if it were also coated in accordance with the invention there.

It is not just in the case of Kretek cigarettes that the problem of the undesired formation of stains occurs frequently, not only on the mouthpiece lining paper of cigarettes themselves but also even on the pack consisting of paper or board in which the cigarettes are packed. The problem increases with increasing storage time and warmer and moister ambient conditions. By means of the invention, a remedy can be created here, by the packaging material, consisting of paper or board, being coated in accordance with the invention, at least on the inner side. In the case in which use is made of cigarette cartons which have a so-called inner liner, it is particularly advantageous even to coat the inner liner on its inner side in accordance with the invention. (The inner liner is the inner, flexible sleeve of a pack comprising a plurality of sleeves located in one another, the sleeve surrounding the inner liner consisting of a stiffer material.)

The invention claimed is:

1. A coating method for wrapping material formed from paper or board for smoking products or parts of smoking products, in order to reduce the tendency of this wrapping material to pick up aqueous or oily substances, and to reduce the diffusion of such substances, the wrapping material being provided on the same side with two coatings applied over one another, which are each applied in liquid form in two coating operations taking place after each other chronologically, in both coating operations the liquid coating mixture comprising:

a coating material and a liquid volatile matrix, wherein in a first coating operation, at least one layer of a first coating material is applied which reduces the absorption capacity of the paper or board with respect to the liquid volatile matrix of the second coating material; and in a second coating operation, at least one layer of a second coating material is applied which is repellent or resistant to one or more of the following substances, namely oils, greases, waxes, alcohols and water, a different liquid volatile matrix being used for the first coating material than for the second coating material, wherein the wrapping material is selected from the group consisting of wrapping materials all which are not combusted during smoking of smoking products wrapped therewith, consisting of:

an inner sleeve of a pack for smoking products comprising a plurality of sleeves arranged inside one another;

an innerliner of a pack for smoking products;

a pack consisting of paper or board in which cigarettes are packed;

a carton as pack for smoking products; and a mouthpiece lining paper of a cigarette or a cigarillo, said mouthpiece lining paper for encasing the filter part of said cigarette or cigarillo.

2. The coating method as claimed in claim 1, wherein the at least the first coating material is hydrophobic.

3. The coating method as claimed in claim 2, wherein the liquid volatile matrix of the second coating material is water or an aqueous solution.

4. The coating method as claimed in claim 3, wherein the liquid volatile matrix of the first coating material is an organic solvent.

5. The coating method as claimed in claim 1, wherein the second coating material is more highly hydrophobic than the first coating material.

6. The coating method as claimed in claim 1, wherein the viscosity of the liquid coating mixture applied in the first coating operation is higher than that of the liquid coating mixture applied in the second coating operation.

7. The coating method as claimed in claim 1, wherein the viscosity of the liquid coating mixture applied in the first coating operation is such that in the ISO 4 mm flow cup test the result is a flow time between 13 and 35 seconds, preferably between18 and 22 seconds;

the viscosity of the liquid coating mixture applied in the second coating operation is such that in the ISO 4 mm flow cup test the result is a flow time between 11 and 23 seconds, preferably between 11 and 12 seconds;

in the first coating operation, 1 to 6 g/m$^2$ of dry application, preferably at least 3 g/m$^2$ of dry application of the first coating material is applied; and in the second coating operation, 1 to 6 g/m$^2$ of dry application, preferably 3 to 3.5 g/m$^2$ of dry application of the second coating material is applied.

8. The coating method as claimed in claim 1, wherein the coating mixture used for the first coating operation is one or more of the varnishes shellac, ethyl cellulose varnish, nitrocellulose varnish or alkyd resin varnish or a varnish with physical properties similar to the aforementioned varnishes with regard to density and hydrophobia;

the coating mixture used for the second coating operation is styrene-acrylate varnish or a varnish with physical properties similar to the aforementioned varnish with regard to density and hydrophobia.

9. The method as claimed in claim 8, wherein at least one coating mixture has additives or further components, such as in particular paraffin wax, added thereto.

10. The method as claimed in claim 1, wherein the application of the two coatings is carried out online in at least two coating devices on a paper web running through, a dryer unit comprising infrared sources or hot air sources being connected downstream of each coating device.

11. The method as claimed in claim 1, wherein it is applied to an absorbent paper having a grammage of at most 80 g/m$^2$, preferably at most 40 g/m$^2$.

12. The method as claimed in claim 1, wherein the first and second coatings are applied to both sides of the paper or board.

13. A wrapping material for smoking products or parts of smoking products, wherein the wrapping material is provided on the same side with two coatings applied over one another, which were applied in liquid form in two coating operations taking place after each other chronologically, in both coating operations the liquid coating mixture comprising:

a coating material and a liquid volatile matrix, wherein the first coating is at least one layer of a first coating material which reduces the absorption capacity of the paper or board with respect to the liquid volatile matrix of the second coating material;

the second coating is at least one layer of a second coating material which is repellent or resistant to one or more of the following substances, namely oils, greases, waxes, alcohols and water;

wherein a different liquid volatile matrix being used for application of the first coating material than for the second coating material, wherein the wrapping material is selected from the group consisting of wrapping materials all which are not combusted during smoking of smoking products wrapped therewith consisting of:

an inner sleeve of a pack for smoking products comprising a plurality of sleeves arranged inside one another;

an innerliner of a pack for smoking products;

a pack consisting of paper or board in which cigarettes are packed;

a carton as pack for smoking products; and mouthpiece lining paper of a cigarette or a cigarillo, said mouthpiece lining paper for encasing the filter part of said cigarette or cigarillo.

14. The wrapping material as claimed in claim 13, wherein the smoking products are Kretek cigarettes, which are cigarettes comprising a tobacco that comprises clove oil, as liquid or as crushed cloves.

15. The wrapping material as claimed in claim 13, wherein the wrapping material is the mouthpiece lining paper of a cigarette or a cigarillo, said mouthpiece lining paper can encases the filter part of said cigarette or cigarillo.

16. The mouthpiece lining paper as claimed in claim 15, wherein when applied to a cigarette the side coated with said first and said second coating is the outer side of said cigarette, and wherein it has at least one further print or coating over said second coating.

17. The mouthpiece lining paper as claimed in claim 16, wherein said further print or coating contains an aqueous, oily, waxy or alcoholic substance.

18. The mouthpiece lining paper as claimed in claim 17, wherein said substance is a natural or artificial flavoring or the carrier material thereof.

19. The mouthpiece lining paper as claimed in claim 15, wherein it is applied to a cigarette or a cigarillo which contains an aqueous, oily, waxy or alcoholic substance, wherein the side coated with said first coating and said second coating faces towards the inner side of said cigarette or a cigarillo.

20. The mouthpiece lining paper as claimed in claim 19, wherein the aqueous, oily, waxy or alcoholic substance is present as a flavoring or carrier material in one or more flavoring capsules.

21. The mouthpiece lining paper as claimed in claim 15, wherein it has a coating formed of said first coating and said second coating on both of its sides.

22. The mouthpiece lining paper as claimed in claim 15, wherein, at least on one side, the coating formed of said first coating and said second coating is interrupted, at least on one surface area of the mouthpiece lining paper which is used as an adhesive area to join a cigarette or cigarillo comprising a plurality of individual parts.

23. The mouthpiece lining paper as claimed in claim 22, wherein said interruption to the coating is located in that area in which, on the finished cigarette, the mouthpiece lining paper overlaps itself.

24. The mouthpiece lining paper as claimed in claim 15, wherein when applied to a cigarette said first coating an said second coating are applied to the outer side of the mouthpiece lining paper in an area which is normally touched by the lips of the smoker, that is to say approximately to the longitudinal third of the mouthpiece lining paper that is located facing away from the tobacco rod of said cigarette.

* * * * *